United States Patent [19]

Lourigan et al.

[11] 4,074,528

[45] Feb. 21, 1978

[54] HYDRAULIC CONTROL SYSTEM WITH PRIORITY FLOW CONTROL

[75] Inventors: Patrick M. Lourigan, Kenosha; Ramkishan Khatti, Racine, both of Wis.

[73] Assignee: J. I. Case Company, Racine, Wis.

[21] Appl. No.: 710,802

[22] Filed: Aug. 2, 1976

[51] Int. Cl.[2] ..... F15B 11/20

[52] U.S. Cl. ..... 60/422; 60/445

[58] Field of Search ..... 60/422, 445, 448, 452, 60/484

[56] References Cited

U.S. PATENT DOCUMENTS

| | | | |
|---|---|---|---|
| 2,799,995 | 7/1957 | Herman | 60/422 X |
| 2,892,311 | 6/1959 | Van Gerpen | 60/422 |
| 3,486,334 | 12/1969 | Miller | 60/445 X |
| 3,750,405 | 8/1973 | Lech et al. | 60/445 X |
| 3,908,375 | 9/1975 | Young | 60/445 X |
| 3,979,908 | 9/1976 | Alderson | 60/422 |

*Primary Examiner*—Edgar W. Geoghegan
*Attorney, Agent, or Firm*—Dressler, Goldsmith, Clement, Gordon & Shore, Ltd.

[57] ABSTRACT

A hydraulic control system for controlling the flow between a reservoir, a pump having pressure flow compensating means associated therewith and first and second flow control means for controlling flow to first and second fluid operated devices is disclosed herein. The hydraulic control system includes a priority flow control valve which maintains a priority of flow from the pump to the first flow control means based upon the amount of flow required as well as the pressure requirements. The priority flow control valve has a valve spool which is positioned as a function of a biasing spring, as well as the pressure of the fluid from the pump to the first flow control means and the pressure of the fluid in the first fluid operated device. The system is particularly adapted for functions requiring higher pressure than low stand-by system pressure and where one of those functions require priority over the other.

5 Claims, 3 Drawing Figures

BRAKE VALVE
TRANSMISSION
STEERING VALVE
L.H. BRAKE
DIFF. LOCK
R.H. BRAKE
10
200
210
202
206
204
16
14
12
15
18
100
102
78
22
20
26
76
34
36
30
24
74
42
32
40
28
72
64
70
44
52
54
56
66
46
58
60
48
50
90
120
79
82
84
80
86
88
104
94
96
92
98

HYDRAULIC CONTROL SYSTEM WITH PRIORITY FLOW CONTROL

BACKGROUND OF THE INVENTION

The present invention relates generally to hydraulic control systems that form part of a vehicle such as an agricultural tractor. More particularly, the present invention relates to a control system that incorporates a pressure-flow compensating pump for delivering pressurized fluid to a plurality of fluid operated devices with a priority flow control valve incorporated therein that establishes priority of flow to a first fluid operated device whenever the pressure or flow requirements for that device are below a certain level.

Hydraulic control systems for controlling various functions that form part of a vehicle such as a tractor have been in existence for many years. Usually the hydraulic control system incorporates one pump for supplying pressurized fluid to a plurality of devices. Because of operational and safety reasons, it becomes necessary for the control system to incorporate some type of priority flow control to some of the devices. For example, in a tractor which incorporates power steering and power brakes, it is essential that at least one of these functions have priority for any flow that is delivered from the pump so that the operator is at all times in control of the vehicle.

In the past, the hydraulic control systems have normally been of either the open-center system or the closed-center system. The open-center system incorporates a fixed displacement pump that is capable of delivering a maximum given flow required for the entire system and a main control valve associated therewith connects the pump directly to the reservoir when the valve is in the neutral position. As expected in a system of this type, the pump is constantly delivering full flow at low pressure when the control valve is in a neutral position which results in considerable energy loss.

Furthermore, in most hydraulic control systems of this type, the system is designed to provide a maximum flow rate that is capable of operating all of the fluid operated devices simultaneously. As can be appreciated, the maximum flow rate for the pump is seldom needed when operating a vehicle of the type under consideration. Thus, in most instances, at least a portion of the power is wasted since the system seldom demands the maximum flow of the pump and the excess flow is bypassed through a pressure relief valve which means that further energy is lost.

The closed-center system incorporates a variable displacement, pressure compensated pump capable of a given maximum flow rate and the system is always operated at a predetermined maximum pressure. In this system, power is again wasted when less than the full pressure is required for operating the devices to which pressurized fluid is being supplied. In this system, the pump is constantly operating at full pressure which may result in heating of the fluid when the system is in a neutral position for extended periods of time.

Quite recently a third type of system has been developed which may be termed as a pressure-flow compensating or "load-sensing" hydraulic system. This type of system is generally disclosed in U.S. Pat. No. 3,486,334. The hydraulic circuit disclosed in this patent consists of a variable displacement pump, the output of which is controlled by a pressure compensating member that is connected to the unit being controlled so that the pump produces the required flow at the required pressure for delivery to the controlled unit. This type of hydraulic circuit delivers low flow at low pressure for minimum pump wear, flow losses and energy losses when the main control valves associated therewith are in a neutral position. The pressure-flow compensated hydraulic system has the unique advantage of being capable of maintaining high pressures without delivering a large volume of fluid and also delivering large volumes of fluid at lower pressures as per application needs. In other words, this system combines the advantages of the open-center system and the constant-pressure closed-center system while avoiding the major disadvantages.

While the pressure-flow compensating hydraulic system has numerous advantages over the other systems described above, to date such system has not found any widespread acceptance. At least one of the reasons for the non-acceptance of such a system is the fact that in the past, more expensive control valves and directional valves were required in the hydraulic circuit utilizing the pressure-flow compensating pump.

SUMMARY OF THE INVENTION

According to the present invention, there is provided a hydraulic control system that includes a reservoir, a pump having pressure compensating means associated therewith and first and second flow control means controlling flow to first and second fluid operated devices with a priority flow control valve in the system. The priority flow control valve is designed to deliver all of the fluid from the pump to the first fluid operated device whenever the pressure or the flow requirements to that device are below a given level.

The priority flow control valve includes a housing having a valve bore with a valve spool slidable therein and cooperating therewith to define first and second chambers on the opposite ends of the spool. The priority flow control valve has an inlet port connected to the pump and a first outlet port connected to a first flow control means that controls the flow to a first fluid operated device. A second outlet port on the priority control valve is connected to a second flow control means which controls the flow of fluid to a second fluid operated device.

The valve spool of the priority flow control valve is normally biased to a first position by a spring in the first chamber and all of the pressurized fluid from the pump is delivered to the first outlet port when the valve spool is in the first position. The pressurized fluid received in the first outlet port is delivered to the second chamber on the opposite end of the valve spool so that the spool is moved as a function of the pressure in the first outlet port. A connection is provided between the first fluid operated device and the pressure compensating means so that the pump is operated as a function of the pressure and flow requirements demanded by the first fluid operated device. This connection is also in communication with the first chamber of the priority valve so that the pressure in the connection means or pilot conduit also controls the position of the valve spool in the valve bore.

In the specific embodiment illustrated, the first fluid operated device is a steering cylinder that forms part of the power steering system for the vehicle while the second fluid operated device consists of the operating means for the brakes that are normally associated with the left and right-hand rear wheels of the vehicle so that flow priority is developed to the steering system for the vehicle.

According to another aspect of the present invention, all of the necessary check valves associated with the secondary or brake circuit portion of the hydraulic control system are housed in a single control housing that can readily be attached to the housing of a commercially available brake control valve, which greatly simplifies the construction and assembly of the overall control system.

The hydraulic control system can also be designed to provide priority control flow to other fluid operated devices, as will be explained in more detail later.

DETAILED DESCRIPTION

Figure 1:
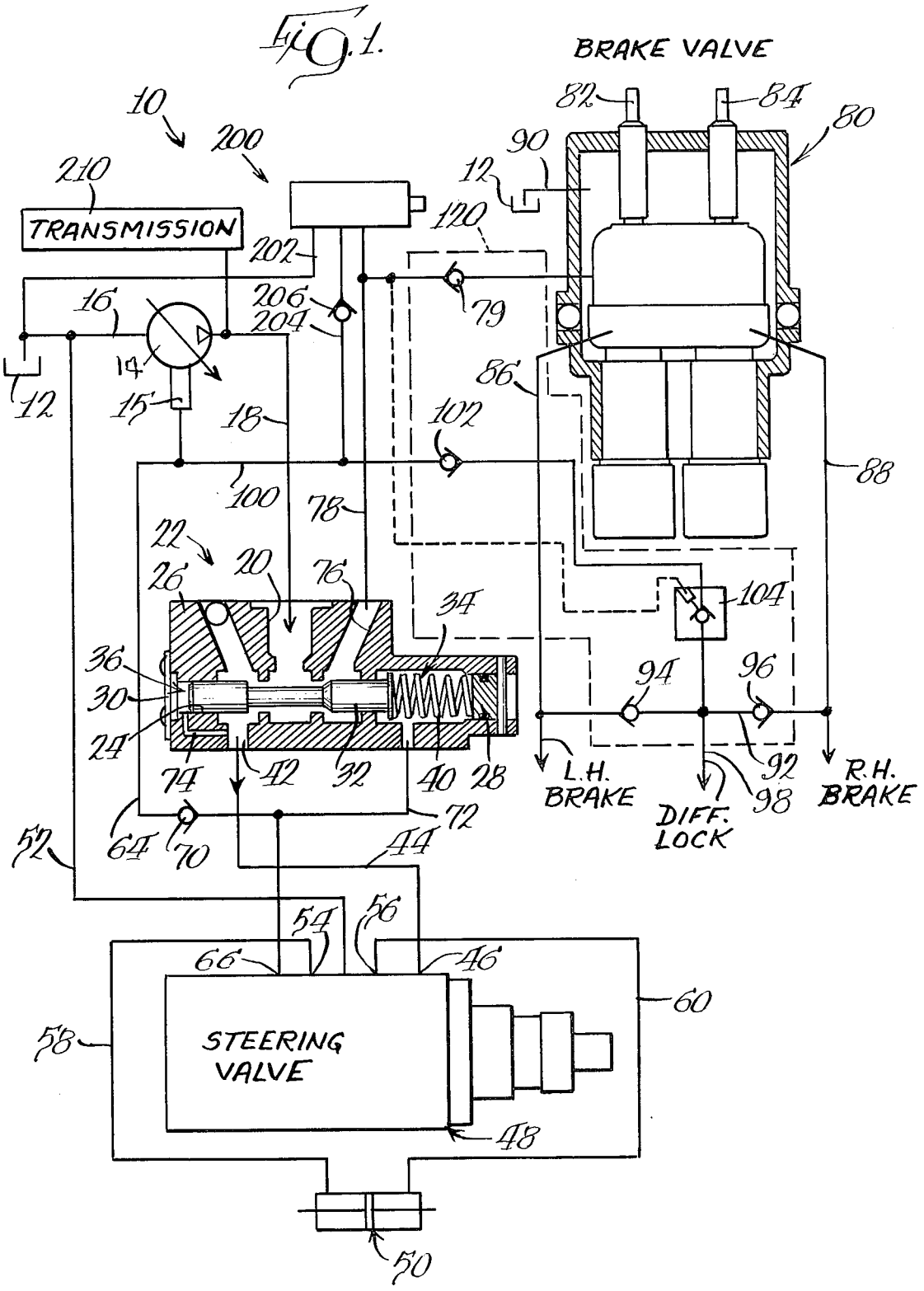
FIG. 1 schematically illustrates the hydraulic control system of the present invention with the priority flow control valve being shown in cross-section.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings discloses a hydraulic control system, generally designated by the reference numeral 10, having the various features of the present invention incorporated therein. Hydraulic control system 10 includes a reservoir 12 and a pump 14 having a pressure and flow compensating means 15 associated therewith. Pump 14 is connected to reservoir 12 through a conduit 16 with the output of pump 14 delivered through conduit 18 to an inlet port 20 of a priority flow control valve 22. Priority flow control valve 22 includes a valve bore 24 extending through housing 26 with opposite ends of the valve bore closed by plug 28 and plate or plug means 30. A valve spool 32 is slidably supported in valve bore 24 and cooperates with housing 26 to define a first chamber 34 at one end of spool 32 and a second chamber 36 at the opposite end of spool 34. Biasing means or spring 40 is located in chamber 34 and normally biases valve spool 32 to a first position, as will be described in more detail later.

Valve housing 26 has a first outlet port 42 connected by conduit 44 to an inlet port 46 in a control valve means 48 that controls flow of hydraulic fluid to and from a fluid operated device, such as a fluid ram 50. Control valve means 48 is illustrated as being a steering valve which controls the flow of fluid to opposite ends of a steering cylinder and piston rod assembly that defines first fluid operated device 50. Steering valve 48 is connected by a return conduit 52 to reservoir 12 and also has first and second outlet ports 54 and 56 respectively connected by conduits 58 and 60 to opposite ends of the cylinder that forms part of fluid ram 50. Thus, actuation of the control valve in either direction from the neutral position will pressurize one of the conduits 58 or 60 while the second conduit will be connected to reservoir 12 through conduit 52.

Fluid ram 50 is also connected to a pressure compensating means 15 associated with pump 14 through connection means which in the illustrated embodiment consists of a conduit 64 connected to a pilot port 66 in steering valve 48 with a unidirectional or ball check valve 70 located in conduit 64 to prevent flow from pressure compensating means 15 to fluid ram 50. Conduit 64 is also connected by branch conduit 72 to the first chamber 34 having spring 40 therein while outlet port 42 of priority flow control valve 22 is connected to second chamber 36 through an opening 74 in valve housing 26.

Steering valve 48 may be a commercially available valve sold by Ross Engineering under part No. HGA12006 with minor modifications of such valve to provide a pilot port which is connected to either end of the cylinder of the fluid ram 50 when the valve is actuated in either direction from the neutral position. Alternatively, steering valve 48 may be the above commercial valve without modifications in which case conduits 58 and 60 would be connected directly to conduit 64 with suitable check valve means associated therewith such as check valves 94, 96 to be described later to prevent flow between the two conduits 58 and 60 with a connection to check valve 70 between the two valves to prevent flow from conduit 64 to either conduit 58 or 60.

Control valve housing 26 has a second outlet port 76 connected by conduit 78 to an inlet of second flow control means or brake valve 80. Brake valve 80 is a commercially available valve sold as part No. 39300-AD by Cessna Corporation. Brake valve 80 has first and second manually actuated valve spools 82 and 84 which, when actuated, respectively supply pressurized fluid through conduits 86 and 88 to the left and right-hand brakes (not shown). In the neutral position for the respective valve spools 82 and 84, conduits 86 and 88 are connected to reservoir 12 through a return conduit 90.

The brake circuit of the hydraulic control system also includes a hydraulically actuated differential lock of the commercially known type which is capable of interlocking the two wheels. This differential lock is hydraulically actuated by supplying pressurized fluid from a separate source to a control valve (not shown). The differential lock is also interconnected with the hydraulic circuit for the left and right-hand brakes so that the differential lock is automatically released when either of the brakes is actuated and both brake conduits are connected to pressure compensating means 15 so that pump 14 may be operated as a function of the pressure and flow requirements in either the left or right-hand brake.

According to one aspect of the present invention, the interconnection means between the brakes and the differential lock as well as the pressure compensating means 15 are interrelated to substantially simplify the number of parts and construction thereof required for providing such interconnection.

As illustrated in FIG. 1, conduits 86 and 88 are interconnected by a conduit 92 that has two oppositely directed unidirectional valves 94 and 96 located therein. These valves prevent flow between left and right-hand conduits 86 and 88 but will accommodate flow from either conduit to a differential lock conduit 98 connected to conduit 92 between the two unidirectional check valves 94 and 96. A further branch conduit 100 leads from between the two check valves 94 and 96 to pressure compensating means 15. Conduit 100 has a unidirectional valve 102 therein which blocks flow from compensating means 15 when the brake or secondary circuit is in a neutral condition. Also, conduit 100 has a pressure responsive check valve 104 located therein and this pressure responsive check valve is opened in response to pressurization of the fluid is conduit 78 leading from priority valve 22 to brake valve 80. Whenever conduit 78 is pressurized, check valve 104 is held in an open position to provide a direct connection from conduit 92 to pressure compensating means 15 through unidirectional valve 102. However, if the fluid is conduit 78 is not pressurized, check valve 104 will be closed and will prevent flow through conduit 100. This allows the operator to provide manual braking power by manual pressurization of the fluid in either conduits 86 or 88 to the respective brakes should hydraulic power be lost.

According to one aspect of the invention, check valves 79, 94, 96, 102 and 104 are all incorporated into a single housing that can readily be attached to the commercially available brake valve 80 to convert the brake valve to a control valve means that can be utilized with a pressure compensating pump. This arrangement simplifies the construction of the system and reduces the overall cost of the system.

Figure 2:
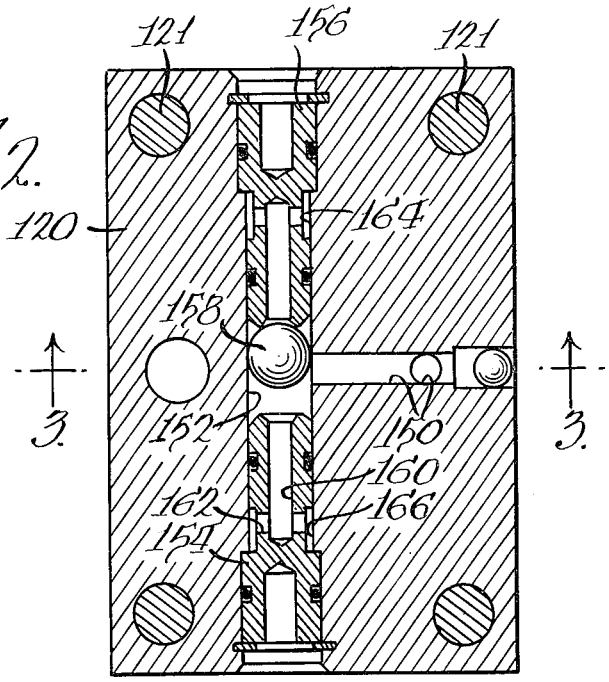
FIG. 2 is a cross-sectional view of a portion of the hydraulic control system that is associated with a commercially available brake valve.
Figure 3:
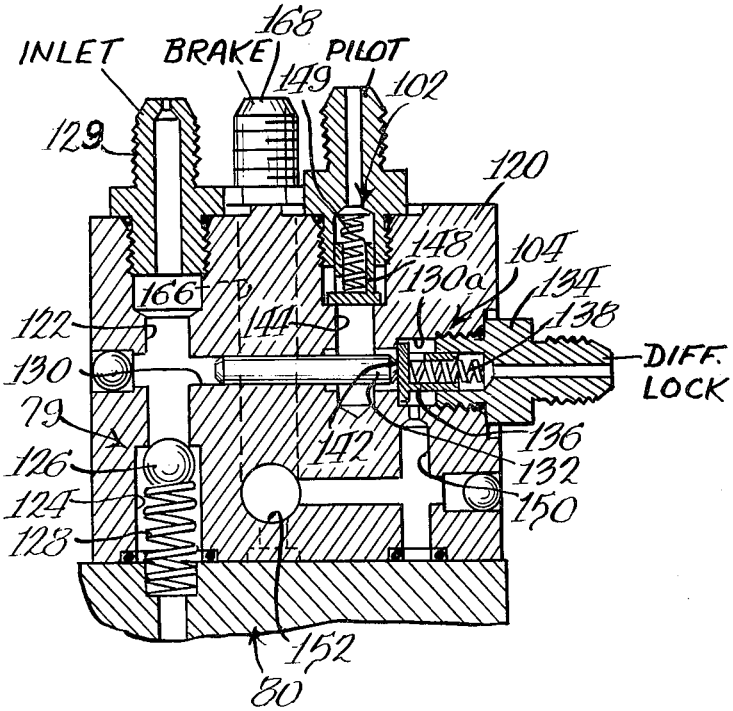
FIG. 3 is a vertical sectional view as viewed along line 3—3 of FIG. 2.

The details of the valve attachment are illustrated in FIGS. 2 and 3. The valve attachment consists of a valve housing 120 that may be connected directly to the housing of brake valve 80 by bolts 121 and housing 120 has an inlet bore 122 extending therethrough with an enlarged portion 124 at one end thereof. The enlarged portion 124 supports a ball check valve 126 that is biased to a closed position by a spring 128 and defines unidirectional valve means 79, illustrated in FIG. 1. A suitable fitting 129 is threaded into the opposite end of bore 122 for providing a connection to conduit 78 leading to housing 120. Inlet bore or port 122 has a transverse passage 130 extending therefrom with a rod 132 slidably supported in passage 130. The opposite end of passage 130 has an enlarged portion 130*a* which receives a threaded fitting 134 therein that is capable of having conduit 98 connected thereto for connection to the circuit for the differential lock (not shown). A spring biased spool 136 is biased by a spring 138 into engagement with a value seat defined at the end of an enlarged portion 130*a* of passage 130. Rod 132 and valve element 136 define pressure responsive valve means 104 illustrated in FIG. 1.

Valve passage 130 has a further intermediate sized portion 142 that is in communication with a further bore 144 having a threaded fitting 146 at the outer end thereof for connection of conduit 100 thereto. A further spring biased valve element 148 is biased into engagement with a valve seat by a spring 149. Vavle element 148 and spring 149 define pilot check valve 102 illustrated in FIG. 1.

The enlarged portion 130*a* of passage 130 is also connected by passage means 150 to a further passage 152 that extends from one end of housing 120 to the opposite end. Passage 152 is closed at both ends by respective plug members 154 and 156 and has a freely movable ball 158 located between the inner ends of the respective plugs. Each plug has an axial opening 160 and a transverse opening 162 with the transverse openings being in communication with perpendicular bores 164 and 166. Bores 164 and 166 extend to the surface of valve housing 120 and have fittings 168 threadedly received therein (only one being shown in FIG. 3). These fittings 168 respectively have conduits 86 and 88 connected thereto. Ball 158 and associated passages 150, 152 define both unidirectional valve means 94 and 96 and conduit 92, illustrated in FIG. 1.

The operation of the circuit so far described will now be summarized. Assuming that steering valve 48 and valve spools 82 and 84 of brake valve 80 are all in the neutral position, there will be no demand for pressurized fluid from pump 14. The pump 14 will then have a minimum flow output at a very low pressure, such as 200 p.s.i. to replenish any fluid leakage within the control system. In this condition, spring 40 will bias valve spool 32 to the first position wherein the flow of fluid from inlet port 20 to second outlet port 76 is blocked. It should be noted that the spring force for spring 40 is such that it is approximately equal to the fluid force on valve spool 32 at the minimum level of 200 p.s.i. Also any flow from first outlet port 42 is blocked by control valve 48.

If a steering function is to be performed, steering valve 48 will be actuated so that pressurized fluid is being demanded either in conduit 58 or conduit 60 while the other conduit will be connected to reservoir 12 through conduit 52. When this condition occurs, the conduit to be pressurized will be connected internally of valve 48 to pilot port 66 and the pressure of the fluid in such conduit will be sensed by pressure compensating means 15. The pressure compensating means 15 will actuate pump 14 to provide the necessary flow of fluid at the required pressure through inlet port 20, valve bore 24, outlet port 42 through valve 48 to the appropriate end of the cylinder that forms part of fluid ram 50. At the same time, the pressure of the fluid in port 42 is delivered through opening 74 to the second chamber 36 to oppose spring force 40 while the pressure of the fluid in conduit 64 is delivered to first chamber 34 to assist spring 40 in maintaining the valve spool in the first position. Thus, the pressure of the fluid in outlet port 42 must reach a certain level before the valve spool can be moved from the first position, to the right as viewed in FIG. 1, to allow fluid under pressure to be delivered to the secondary port 76. Stated another way, valve spool 32 is normally held in a first position, when hydraulic fluid is demanded by steering valve 48 to block flow to the secondary circuit consisting of brake valve 80 and the movement of the valve spool from the first position is controlled by the pressure of fluid in outlet port 42, the pressure of fluid in the pilot conduit 64 as well as the spring force 40.

Assuming now that all of the pressure and flow requirements for producing the desired steering functions are met, the pressure of the fluid in outlet port 42 and opening 74 as well as chamber 36 will increase sufficiently to move the valve spool 32 to the right as viewed in FIG. 1 and, therefore, connect inlet port 20 to second outlet port 76 so that pressurized fluid from pump 14 is available for actuating either the left or right-hand brake. Assuming now that one of the brake spools 82 or 84, such as brake spool 82, is actuated, such actuation will produce a demand for pressurized fluid in conduit 86. This demand for pressurized fluid will be sensed by pressure compensating means 15 through check valve 94, pressure responsive valve 104 (which is now held open by the pressure of fluid in conduit 78), check valve 102 and conduit 100. The drop in pressure within conduit 86 will produce a demand for increased pump output from pump 14 so that pump 14 will produce the desired amount of fluid at the required pressure for actuating the brake.

If there is no demand for pressurized fluid to steering valve 48, any pressure demands for fluid to conduit 78 will also be delivered through opening 74 to chamber 36 to cause valve spool 32 to move to the right, as viewed in FIG. 1, to a position where ultimately first outlet port 42 will be blocked by valve spool 32 and all of the fluid from pump 14 will be delivered to second outlet port 76 and ultimately to brake valve 80.

Thus, it will be appreciated from the above description that the present hydraulic control system provides a very simple arrangement for providing priority flow to one of two fluid operated components. If desired, this same system can also be utilized to provide pressurized fluid for various other functions. For example, as illustrated in FIG. 1, conduit 78 could be connected to a further auxiliary control valve 200 which could be connected to reservoir 12 by a conduit 202 and to pressure compensating means 15 through a conduit 204 having a unidirectional valve 206 therein. The auxiliary valve could be part of the circuit that provides pressurized fluid to hydraulic components, such as the draft control system for the vehicle or pressurized fluid to trailing implements, such as tilling devices which are hydraulically actuated. If desired, a pressure regulating valve could be located between conduit 78 and control valve 200 to prevent flow to control valve 200 when the pressure of the fluid in conduit 78 is below a certain level required for actuation of the brakes. This would insure priority of flow to the secondary circuit consisting of brake valve 80 before fluid is available for operating the auxiliary circuit.

It is also contemplated within the spirit of this invention that a further control valve 200 could be replaced with a further priority control valve 22 and, therefore, two additional hydraulic circuits could be controlled with a single pump. Again, priority of flow could be established for one of the two circuits as explained with respect to the basic hydraulic control circuit disclosed herein.

The same hydraulic control system can also be utilized for supplying pressurized fluid to other fluid operated circuits which require very low pressure. For example, hydraulically actuated transmissions of the type incorporated into many agricultural tractors of the type under consideration can be actuated by fluid pressure that is pressurized to less than 200 p.s.i. Thus, in the control system illustrated and described above, the conduit 18 could be connected directly to a transmission circuit 210 and provide the necessary pressurized fluid for actuating the various hydraulic components in the transmission. This arrangement would not in any way deter from the priority of flow to the steering valve 48 since any demand for fluid to the steering valve would automatically increase the pressure in conduit 18.

It should also be realized that while the two fluid operated devices have respectively been illustrated as a steering ram 50 and left and right-hand brakes, the system could readily be designed for providing priority flow to any particular function, such as a brake circuit with other functions, or a steering system with other functions such as a remote hydraulic system associated with an implement and a draft control circuit that controls the movement of a hitch on the tractor.

What is claimed is:

1. A hydraulic control system including a reservoir, a pump having pressure compensating means associated therewith, first and second flow control means controlling flow to first and second fluid operated devices and a priority flow control valve between said flow control means and said pump, said priority flow control valve including a housing having a valve bore therein with a valve spool slidable in said valve bore and cooperating therewith to define first and second chambers on opposite ends of said spool, biasing means in said first chamber biasing said spool to a first position, said housing having an inlet port connected to said pump and communicating with said bore and first and second outlet ports respectively connected to said first and second flow control means, said first outlet port being in communication with said inlet port when said valve spool is in said first position while said valve spool blocks flow to said second outlet port, means connecting said first outlet port to said second chamber, connection means between said first fluid operated device and said pressure compensating means providing pilot pressure flow from said first fluid operated device to said pressure compensating means when said first control means is in either actuated position to operate said pump as a function of the pressure of fluid in said first fluid operated device, said connection means being connected to said first chamber so that said valve spool is moved as a function of the pump pressure, the pilot pressure and the biasing means, unidirectional valve means in said connection means preventing flow from said pressure compensating means to said first chamber and said first fluid operated device, said second fluid operated device including first and second fluid operated brake actuating means with first and second conduits connecting said first and second fluid operated brake actuating means to said second flow control means, a branch conduit between said first and second conduits having a pair of opposed unidirectional valves therein preventing flow between said first and second conduits and unidirectional valve means connected to said branch conduit between said opposed unidirectional valves and to said pressure compensating means for preventing flow from said pressure compensating means to said first and second fluid operated brake actuating means.

2. A hydraulic control system as defined in claim 1, in which said second flow control means includes a brake valve having a housing with a brake inlet, further including a housing attachment connected to said brake valve and having a bore extending therethrough and connected at one end with said second outlet port and at the opposite end connected to said brake inlet, said bore having a spring biased ball check valve therein preventing flow from said brake actuating means to said pressure compensating means, said housing attachment having passage means extending from said bore and connected to said first and second fluid operated brake actuating means and a ball freely movable in said passage means and having first and second positions, said ball defining said opposed unidirectional valves and said passage means defining said branch conduit with said unidirectional valve means connected to said passage means between said bore and said ball.

3. A hydraulic control system as defined in claim 2, further including pressure responsive valve means in said passage means between said unidirectional valve means and said ball, said pressure responsive valve means being opened in response to pressurized fluid in said bore, an additional conduit leading from said passage means between said ball and said pressure responsive means.

4. A hydraulic control system as defined in claim 1, in which said second outlet port of said priority flow control valve is also connected to an auxiliary valve for controlling flow to auxiliary equipment.

5. A hydraulic control system as defined in claim 4, in which said pump is connected to a hydraulically actuated transmission control system for supplying fluid thereto.

* * * * *